United States Patent [19]

Grollimund

[11] 4,322,043

[45] Mar. 30, 1982

[54] WEB TRANSPORT APPARATUS

[75] Inventor: Everett C. Grollimund, Midlothian, Va.

[73] Assignee: Philip Morris, Incorporated, New York, N.Y.

[21] Appl. No.: 160,551

[22] Filed: Jun. 18, 1980

[51] Int. Cl.[3] ..... B65H 17/08; B65H 35/04

[52] U.S. Cl. ..... 242/67.3 R; 83/650; 226/108; 226/196; 242/76; 242/181; 352/123

[58] Field of Search ..... 226/97, 108, 109, 110, 226/196, 200; 242/180, 181, 67.3 R, 55, 76, 58; 83/272, 650; 352/6, 7, 8, 9, 123

[56] References Cited

U.S. PATENT DOCUMENTS

| | | | |
|---|---|---|---|
| 1,313,733 | 8/1919 | Ramsher | 242/181 |
| 1,914,293 | 6/1933 | Reynolds | 226/110 X |
| 1,945,863 | 2/1934 | Mitchell . | |
| 2,290,071 | 7/1942 | Rinaldy | 352/123 |
| 2,531,376 | 11/1950 | Langdon | 226/110 X |
| 2,755,030 | 7/1956 | D'Ornellas | 242/181 |
| 3,098,409 | 7/1963 | Mathieu | 242/181 X |
| 3,262,357 | 7/1966 | Warzynski et al. | 352/123 X |
| 3,342,541 | 9/1967 | Mouissie et al. | 352/123 |
| 3,367,590 | 2/1968 | Girard | 242/181 |
| 3,561,853 | 2/1971 | Thevenaz | 352/123 |
| 3,715,086 | 2/1973 | Angelstrand et al. | 242/67.3 R |

*Primary Examiner*—Stanley N. Gilreath

*Attorney, Agent, or Firm*—Arthur I. Palmer, Jr.; George M. J. Sarofeen

[57] ABSTRACT

A web transport apparatus having an active support structure defining an active web transport path and a storage support structure defining a web storage path parallel to the active path. In use, the apparatus is juxtaposed with a treatment device so that the active path extends through the active zone of the treatment device. A sequence of semi-continuous webs may be treated by feeding each web along the active path while the next web is being threaded along the storage path, and shifting the next web laterally from the storage path to the active path upon exhaustion of the web being fed along the active path. The treatment device can remain operative while the storage path is being threaded.

21 Claims, 7 Drawing Figures

WEB TRANSPORT APPARATUS

BACKGROUND OF THE INVENTION

The present invention relates to web handling, and more particularly relates to web transport apparatus for feeding webs through web treatment apparatus.

In numerous industrial applications, flat materials such as paper, film, foil and the like are handled in semi-continuous web form. Such materials are often processed by drawing each web through the active zone of a treatment device and operating the treatment device while the web is moving through it.

Web transport apparatus is used to draw the webs through the treatment device. The transport apparatus normally includes a payout stand, a takeup stand and support structure defining a transport path which extends from the payout stand to the takeup stand. The transport apparatus is juxtaposed with the treatment device so that the transport path extends through the active zone of the treatment device. A coil containing each web is loaded into the payout stand and the leading end of the web is threaded along the transport path to the takeup stand. The web is then drawn through the active zone of the treatment device by winding it onto a coil at the takeup stand while unwinding it from the coil at the payout stand.

After each web has been completely fed through the apparatus in this manner, it is removed from the apparatus and a new web is loaded and threaded. With the web transport apparatus of the prior art, the treatment device has been idle during each such unloading and reloading cycle. Certain types of web treatment devices can process webs at extremely high speeds. The web transport apparatus associated with such devices must be reloaded frequently so that the productive capacity of such treatment devices is diminished.

For example, a laser beam treatment device can perforate cigarette tipping paper drawn through it at a linear speed of up to 7,000 feet per minute. Even if the paper is supplied in webs of the maximum practicable length, the transport apparatus used with such a treatment device must be reloaded after only about 2 to 3 minutes of operation. If each such reloading cycle takes only one minute, from 25 to 33 percent of the productive capacity of the treatment device will be lost.

BRIEF SUMMARY OF THE INVENTION

It is an object of the present invention to provide web transport apparatus which can be unloaded, threaded and reloaded while it is drawing a web through a treatment device, so that the associated treatment device can be operated without any but insubstantial interruption.

It is another object of the present invention to provide a method of feeding a series of webs through a treatment device which minimizes interruption in operation of the treatment device.

As used herein, the term "downstream" refers to the direction of movement of the linearly-extensive portions of a web in a travel course in the web transport apparatus. The term "upstream" refers to the direction opposite to the downstream direction. The terms "lateral" and "laterally" refer to directions transverse to the web travel course.

The web transport apparatus of the present invention includes a pair of payout stands and a pair of takeup stands. Each of the takeup stands is associated with one of the payout stands. The apparatus also includes an active support structure for supporting a web extending from either of the payout stands to the associated takeup stand on an active path so that such web can be fed from such payout stand to such takeup stand. A storage support structure is provided for simultaneously supporting a web extending from the other one of the payout stands to its associated takeup stand on a storage path which is parallel to the active path but laterally remote from the active path. Web shift means are provided for laterally moving a web from the storage support structure to the active support structure so as to shift it from the storage path to the active path.

In use, the transport apparatus is juxtaposed with the desired treatment apparatus so that the active path of the transport apparatus extends through the active zone of the treatment apparatus, and any web moving along the active path can be processed by the treatment apparatus during movement along the active path.

A sequence of semi-continuous webs can be treated by threading each web from one of the payout stands to the associated takeup stand along the storage path while the immediately preceding web in the sequence is fed from the other payout stand to the associated takeup stand along the active path. When the web being so fed along the active path has been exhausted and the active path is empty, the web which is disposed in the storage path is laterally shifted onto the active path. While this replenishment web in turn is being fed through the treatment apparatus on the active path, the preceding web is removed from the takeup stand onto which it was fed and a new web is installed on the associated payout stand and threaded along the storage path to such takeup stand.

Thus, the unloading of processed webs and loading of new webs to be processed is accomplished while the treatment apparatus is running. The treatment apparatus is only inactive during the brief periods required to laterally shift each web from the storage path into the active path and accelerate it along the active path.

These and other objects, features and advantages of the present invention will be more readily apparent from the following detailed description of the preferred embodiments when read in conjunction with the accompanying drawings, in which like reference numerals are used to denote like features in the various views.

DETAILED DESCRIPTION OF THE PREFERRED EMBODIMENTS

Figure 1:
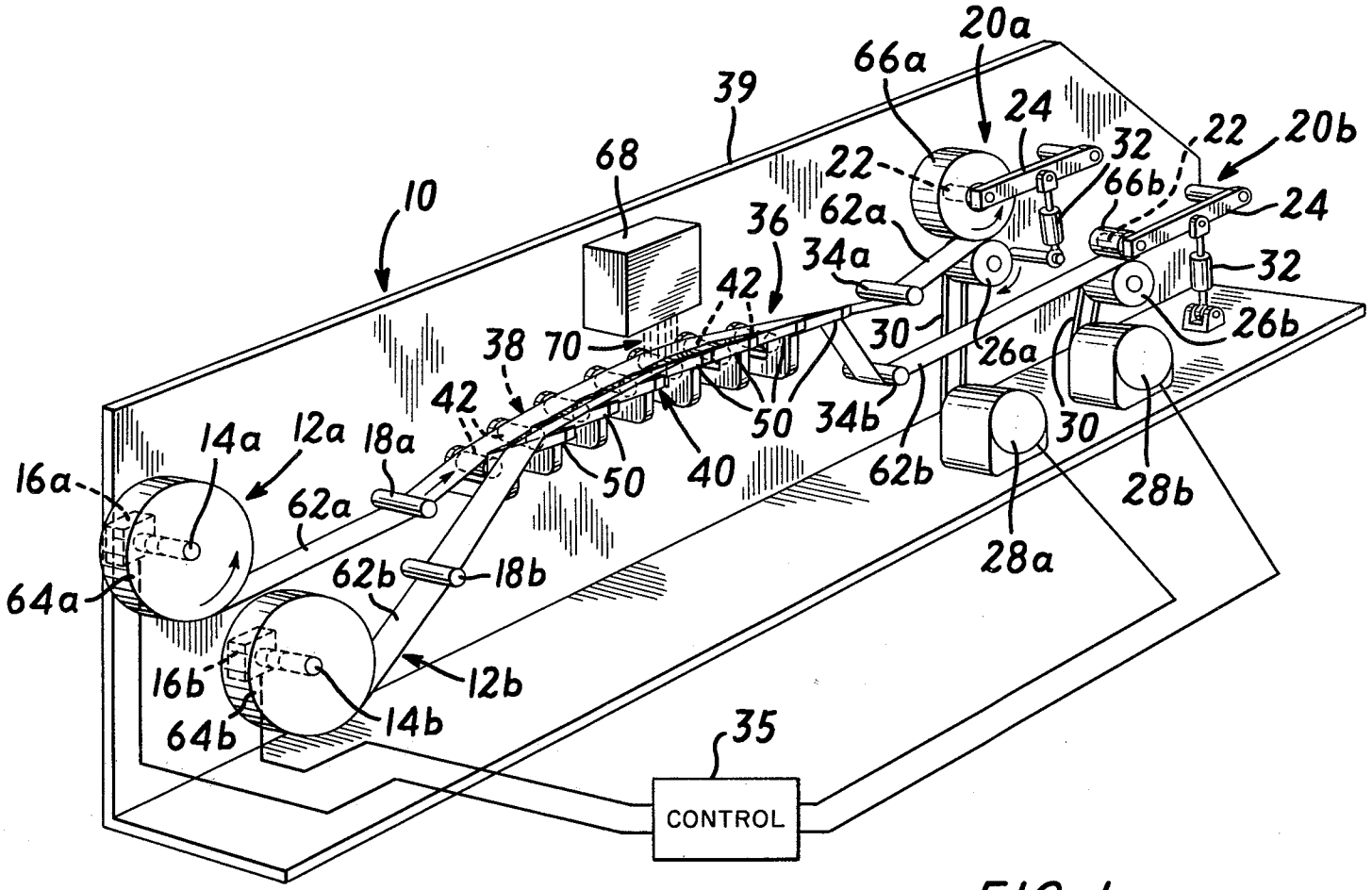
FIG. 1 is a schematic perspective view of web transport apparatus according to the preferred embodiment of the present invention in conjunction with typical web treatment apparatus.

As shown in FIG. 1, web transport apparatus according to a preferred embodiment of the present invention includes a frame 10 and a pair of payout stands **12*a* and 12*b* disposed at the upstream end of the frame. Each payout stand includes a supply coil shaft 14***a*, 14*b* which is rotatably mounted to the frame 10 and a brake 16*a*, 16*b* at the inboard end of the shaft. Each payout stand also includes a web directing roller 18*a*, 18*b* rotatably mounted to the frame 10 downstream from the associated supply coil shaft. Appropriate conventional devices (not shown) are provided for releasably retaining a coil containing a web to be processed on each of the supply coil shafts.

The apparatus also includes a pair of takeup stands 20*a* and 20*b*. Each takeup stand includes a takeup coil shaft 22*a*, 22*b* which is rotatably mounted on an arm 24 which in turn is pivotally mounted to the frame 10. Each of the takeup stands also includes a drive roller 26*a*, 26*b* and a drive motor 28*a*, 28*b* connected with such drive roller by a belt 30. The drive roller of each takeup stand is rotatably mounted to the frame beneath the takeup coil shaft of such takeup stand. Each takeup stand also includes a fluid operated cylinder 32 which is connected to the arm 24*a*, 24*b* of such takeup stand and to the frame. The cylinders 32 are connected to an appropriate source of pressurized fluid (not shown) through appropriate valving so that the arm and takeup coil shaft of each takeup stand may be biased selectively downwardly towards the drive roller 26 of such takeup stand. Each takeup stand also includes a web directly roller 34*a*, 34*b* which is rotatably mounted to the frame upstream of the takeup coil shaft and drive roller of such takeup stand.

The brakes 16*a*, 16*b* of the payout stands 12*a*, 12*b* and the drive motors 28*a*, 28*b* of the takeup stands 20*a*, 20*b* are each connected with an appropriate control apparatus 35.

Figure 2:
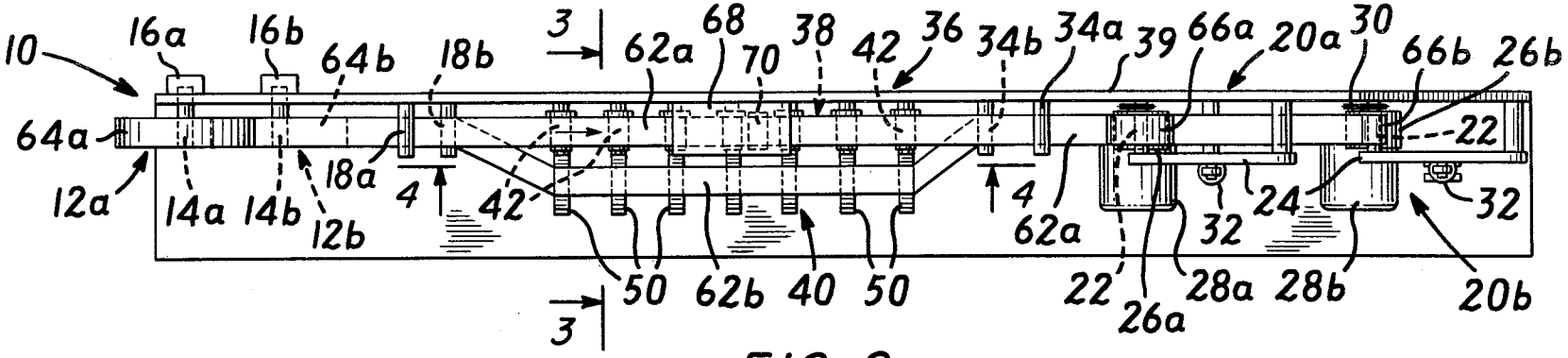
FIG. 2 is a schematic plan view of the apparatus depicted in FIG. 1.
Figure 4:
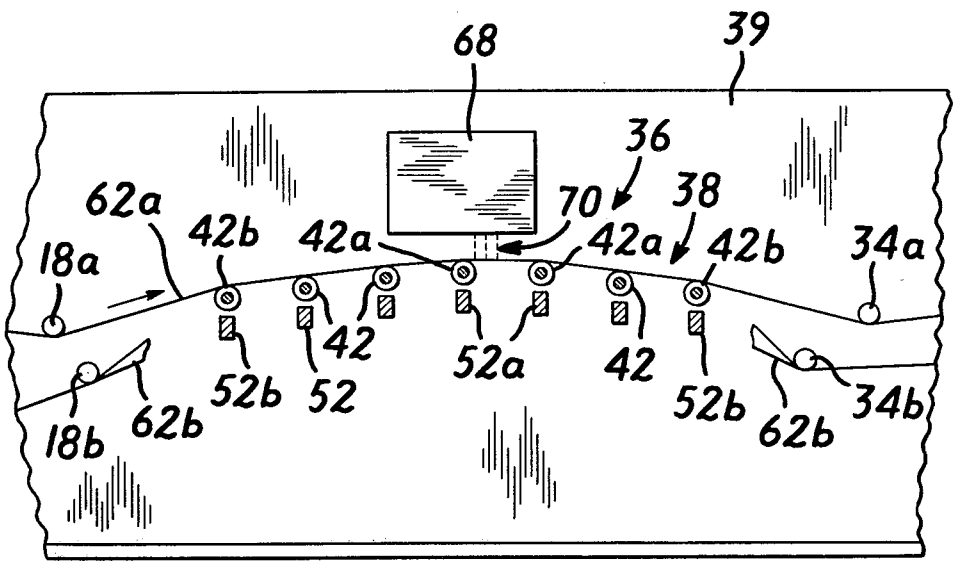
FIG. 4 is a fragmentary sectional view taken along line 4—4 in FIG. 2.
Figure 3:
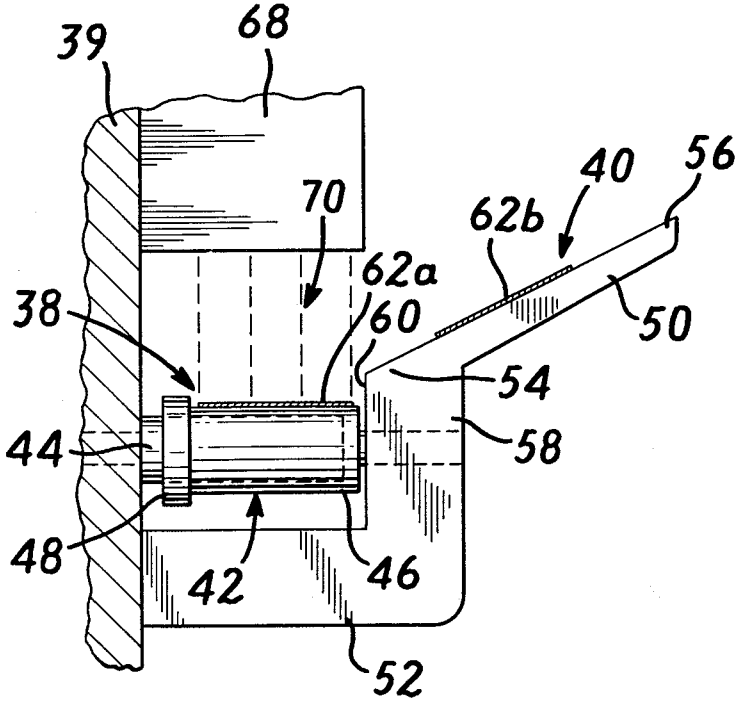
FIG. 3 is a fragmentary sectional view taken along line 3—3 in FIG. 2.

Web support means 36 is provided between the payout stands 12*a*, 12*b* and the takeup stands 20*a*, 20*b*. As best seen in FIGS. 2 and 3, the web support means 36 includes an active support structure 38 adjacent to the back plate 39 of the frame and a storage support structure 40 remote from the back plate 39. The active support structure 38 includes a plurality of struts 42 which are disposed in parallel side by side relation so that the struts extend in a row and define a linearly-extensive active path. As shown in FIG. 3, each strut 42 includes an internal member 44 which is fixedly mounted to the back plate 39 of the frame and an external cylindrical roller 46 which is rotatably mounted to the internal member 44 by suitable anti-friction bearings (not shown). Each roller 46 is provided with a shoulder 48 at its end adjacent to the back plate 39 of the frame. As shown in FIG. 4, the struts 42*a* at the center of the row are disposed higher than the struts 42*b* at the ends of the row. When a web is being fed along the active path, these differences in elevation will help to maintain tension in those portions of the web which are at the middle of the active path.

The storage support structure 40 (FIGS. 2 and 3) includes a plurality of sloping storage support rods 50 which are supported in side by side relation with one another by brackets 52. The lower end 54 of each support rod 50 is adjacent to the active support structure 38; the upper end 56 of each of the storage support rods is remote from the active support structure. The lower end 54 of each of the storage support rods is disposed above the associated bracket 52 by the same amount. As seen in FIG. 4, the brackets 52*a* at the middle of the row are disposed at higher elevations than the brackets 52*b* at the end of the row. The storage support rods 50 in the middle of the row are disposed at higher elevations than the storage support rods at the ends of the row. This arrangement helps to maintain tension in any web disposed on the support rods.

The lower end 54 of each storage support rod is adjacent to the outboard end of one of the struts 42 but is at a higher elevation than such strut. A connecting column 58 extends from the lower end of each storage support rod to the associated bracket 52. The inner face 60 of each such column lies immediately adjacent to the outboard end of the associated strut 42.

As seen in FIGS. 2 and 4, the directing rollers 18*a* and 18*b* of the payout stands lie upstream of the support means 36 and are disposed at elevations lower than the elevation of the end struts 42*b* of the active support structure. The directing rollers 34*a* and 34*b* of the takeup stands are disposed downstream of the support means 36 and at lower elevations than the end struts 42*b* of the active support structure.

Each of the payout stands 12*a* and 12*b* is associated with one of the takeup stands 20*a* and 20*b*. Thus, as best seen in FIG. 1, the web 62*a* which extends from a supply coil 64*a* on the supply coil shaft 14*a* of the upper payout stand 12*a* extends to a takeup coil 66*a* on the takeup coil shaft 22 of the upper takeup stand 20*a*. The web 62*b* which extends from the supply coil 64*b* on the supply coil shaft 14*b* of the lower payout stand 12*b* extends to the takeup coil 66*b* on the takeup coil shaft 22 of the lower takeup stand 20*b*.

As seen in FIGS. 1 and 2, the web 62*a* which extends from the upper payout stand 12*a* to the associated upper takeup stand 20*a* extends over the struts 42 of the active support structure 38. That is, the web 62*a* is supported by the active support structure on the active path defined by the struts 42. The web 62*b* extending from the lower payout stand 12*b* to the associated lower takeup stand 20*b* is received on the storage support rods 50 of the storage support structure 40. That is, the web 62*b* is supported on a storage path defined by the top surfaces of the storage support rods 50.

As best appreciated with reference to FIGS. 2 and 3, the storage path defined by the support rods 50 of the storage support structure 40 is parallel to but laterally displaced from the active path defined by the struts 42 of the active support structure 38. However, both of the payout stands 12*a* and 12*b* are arranged to dispense their respective webs in lateral alignment with the active path and both of the takeup stands 20*a* and 20*b* are arranged to receive their respective webs in lateral alignment with the active path. The payout stands are both arranged to hold their respective supply coils 64*a* and 64*b* in lateral alignment with the active path, and the directing rollers 18*a* and 18*b* of the payout stands are both laterally aligned with the active path. The takeup stands 20*a* and 20*b* are both arranged to hold their respective takeup coils 66*a* and 66*b* in lateral alignment with the active path and the directing rollers 34*a* and 34*b* of both takeup stands are laterally aligned with the active path. Thus, as will be readily appreciated with reference to FIGS. 1 and 2, the web 62*a* which extends along the active path from the upper payout stand 12*a* to the upper takeup stand 20*a* can be fed along the active path without going through any lateral travel course deviation, and such web can therefore be fed reliably at high speed.

The support structures can also accommodate webs in an arrangement inverse to that depicted in the drawings. In such inverse arrangement, the web which extends from the lower payout stand 12*b* to the lower takeup stand 20b will extend along the active path defined by the active support structure 38 and the web which extends from the upper payout stand 12a to the upper takeup stand 20a will extend along the storage path defined by the storage support structure 40. In this inverse arrangement, as in the arrangement depicted in the drawings, the two webs will not contact one another.

Thus, the active support structure 38 can support a web extending from either one of the payout stands 12a or 12b to the associated one of the takeup stands 20a or 20b so that such web can be fed along the active path, and the storage support structure 40 can simultaneously support a web extending from the other one of such payout stands to the associated takeup stand.

The web transport apparatus described above is utilized in conjunction with web treatment apparatus. The web treatment apparatus is depicted by way of illustration in the drawings as being a laser beam emitting unit 68 which is arranged to emit pulses of intense coherent light at preselected intervals. These pulses are directed downwardly along preselected axes within the active zone 70 of the treatment apparatus. Thus, the light beams emitted by the treatment apparatus will impinge on any web which is fed through this zone. Treatment apparatus of this type is used, for example, in perforating cigarette tipping paper; the light beams impinging on the paper burn holes in it and perforate it. It should be understood that the web transport apparatus described above can be utilized with other types of web treatment apparatus including, for example, spark perforation devices.

The treatment apparatus 68 is juxtaposed with the web transport apparatus, as by mounting the treatment apparatus to the frame of the web transport apparatus, so that the active path defined by the active support structure 38 of the web transport apparatus extends through the active zone 70 of the treatment apparatus, but the storage path defined by the storage support structure 40 of the web transport apparatus does not extend through the active zone of the treatment apparatus.

When the web transport apparatus described above is juxtaposed with web treatment apparatus in this manner, the resulting combination can be utilized to treat a series of webs, each supplied in the form of a coil, in the following manner: At start up, two supply coils are loaded into the apparatus, each being received on the supply coil shaft of one of the payout stands. The leading end of the web contained in one such coil is threaded from the payout stand on which the coil is mounted along the active path to the associated takeup stand. The leading end of the web contained in the second coil is threaded from the payout stand on which such coil is mounted to the associated takeup stand along the storage path. As seen in the drawings, the web 62a corresponds to the web of the first coil and the web 62b corresponds to the web of the second coil. The brake 16b associated with the payout stand holding the web which extends along the storage path is engaged by the control means 35 to maintain tension in such web. Such tension holds the web 62b firmly against the upper surfaces of the storage support rods 50.

The motor 28a of the takeup stand associated with the web extending along the active path is operated to draw the first web 62a along the active path defined by the active support structure 38 and thus feed this web through the treatment zone 70 of the treatment apparatus. Of course, this action causes the web 62a to unwind from the supply coil 64a and wind onto the takeup coil 66a. The control means 35 engages the brake 16a of the payout stand 12a so as to maintain tension in the web 62a while it is being fed. The treatment apparatus is operated to treat the web while it is being fed.

When the first web 62a has been completely transferred from the supply coil 64a to the takeup coil 66a the active path will be empty and it will be ready to accept the second web 62b. To shift the second web 62b from the storage path to the active path, the control means releases the brake 16b associated with the payout stand 12b and starts the motor 28b of the takeup stand 20b. The motor 28b rotates the drive roller 26b of the lower takeup stand to draw the second web 62b into the lower takeup stand and wind it onto the takeup coil 66b. As the second web 62b starts to wind onto the takeup coil 66b, that portion of the second web 62b which is supported on the storage support rods 50 of the storage support structure 40 slides downwardly along the top surfaces of the support rods 50 until it drops onto the active support struts 42 of the active support structure 38. Thus, the second web is rapidly positioned on the active path defined by the active support structure.

It is believed that this sliding action is facilitated by two mutually contributing factors. First, release of the brake 16b by the control means reduces the tension in the web 62b and thereby reduces the force with which the web 62b bears on the storage support rods. Second, because the web 62b is moving downstream under the influence of the takeup stand 20b, the coefficient of friction between the web 62b and the top surfaces of the storage support rods is the dynamic coefficient of friction rather than the static coefficient of friction. Because the dynamic coefficient of friction is generally lower than the static coefficient of friction, such movement of the web helps to release the frictional engagement between the web and the support rods.

Once the second web has been shifted onto the active path as described above, the brake 16b is reengaged by the control means to tension the web 62b and the motor 28b of the lower takeup stand is brought up to normal operating speed by the control means, thus accelerating the second web along the active path. The second web 62b will be fed under tension along the active path through the treatment zone 70 of the treatment apparatus, and the treatment apparatus can be operated to treat the second web as it is being fed.

While the second web is being fed along the active path and processed by the treatment apparatus, a supply coil holding a third web (not shown) is installed on the supply coil shaft 14a of the upper payout stand 12a. This third web is then threaded from the upper payout stand to the upper takeup stand along the storage path, and the control means activates the brake of the upper payout stand to tension the third web and help retain it on the storage path. When the second web has been completely fed from the lower payout stand to the lower takeup stand, the control means releases the brake of the upper payout stand and starts the motor of the upper takeup stand to shift this third web into the active path. As will be readily appreciated, this process can be continued indefinitely; as each web in a sequence of webs is being fed along the active path from one of the payout stands to the associated takeup stand, the next web in the sequence is threaded between the other payout stand and the associated takeup stand along the storage path so that such next web is ready for transfer to the active path.

Thus, the treatment apparatus is only inactive while a web is being shifted from the storage path to the active path and accelerated along the active path. Each such shifting and acceleration period will ordinarily last for only a few seconds. The treatment apparatus will continue to run while a coil holding a fully treated web is unloaded from one of the takeup stands, a new supply coil is loaded onto the associated payout stand and the web contained in such coil is threaded along the storage path.

Figure 5:
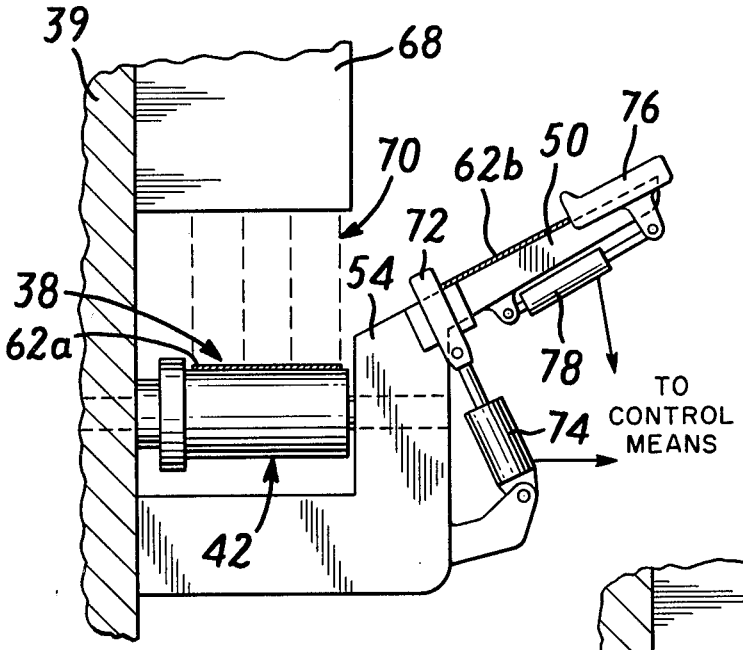
FIGS. 5, 6 and 7 are each fragmentary sectional views similar to FIG. 3, each of these views depicting a different alternate embodiment of the present invention.

Web transport apparatus according to an alternate embodiment of the present invention is partially depicted in FIG. 5. This apparatus is similar to the apparatus described above. However, a catch finger 72 is slidably mounted to each of the storage support rods 50 of this apparatus. Each such catch finger is linked to a fluid operated cylinder 74 which in turn is connected to the control means of the apparatus. Thus, each such catch finger can be selectively moved between the blocking position depicted in FIG. 5, in which it extends upwardly above the top surface of the associated storage support rod 50 and a retracted position wherein it is recessed beneath such top surface. When the catch fingers are in their blocking positions, as depicted in FIG. 5, they will prevent the web 62*b* which is supported on the storage support rods 50 from sliding downwardly onto the active path. However, when the catch fingers are retracted, they will permit a web to slide from the storage path to the active path.

A pusher 76 is slidably mounted to the storage support rods 50 of the apparatus depicted in FIG. 5. The pusher is connected to a fluid operated cylinder 78 which in turn is connected to the control means of the apparatus. The cylinder 78 can be activated by the control means to move the pusher from the web engaging position depicted in FIG. 5, in which the pusher is adjacent to the upper end of the storage support rods 50, downwardly along the storage support rods to an advanced position in which the pusher 76 is adjacent to the lower ends 54 of the storage support rods. Such movement of the pusher will cause any web which was initially positioned on the storage rods to slide downwardly along the storage support rods to the active support structure 38.

The control means of this apparatus is arranged to operate the cylinders associated with the catch fingers 72 and the pushers 76 so that the catch fingers are retained in their blocking positions and the pusher is retained in its retracted or web engaging position except during transfer of a web from the storage path to the active path. During such transfer, the control means activates the cylinders associated with the catch fingers to retract them from their blocking positions and activates the cylinder associated with the pusher to advance it down the support rods. Thus, any web disposed on the support rods 50 will be positively retained thereon by the catch fingers until such time as transfer is desired and will then be positively shifted by the pusher.

Figure 6:
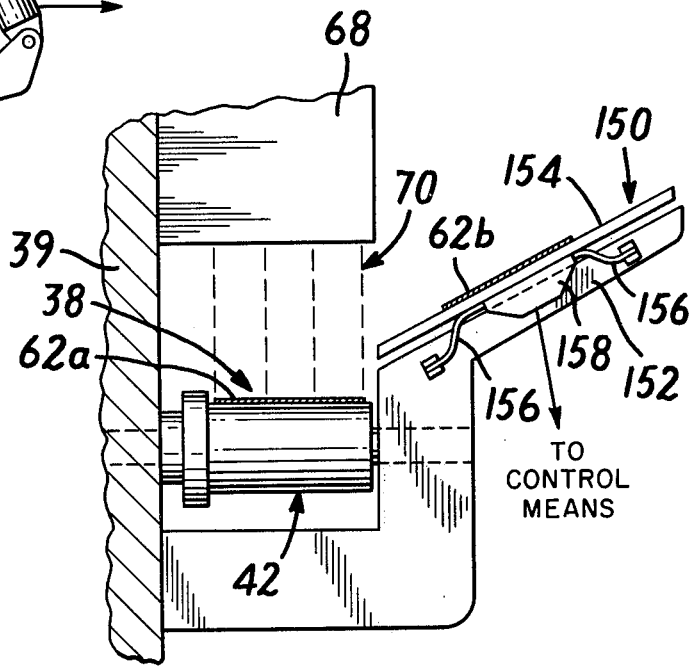

Apparatus according to a further alternate embodiment of the present invention is partially depicted in FIG. 6. This apparatus is similar to the apparatus described above with reference to FIGS. 1 through 4. However, each of the storage support rods 150 of the apparatus depicted in FIG. 6 includes a lower element 152 and an upper element 154. The lower element of each support rod is fixed to the frame 10 of the apparatus. The upper element 154 of each support rod is connected to the lower element of such support rod by a pair of leaf springs 156. A vibrator 158 is mounted to the underside of each of the upper elements 154. Each vibrator 158 is connected to the control means so that the vibrator 158 can be selectively activated by the control means.

This apparatus is operated in much the same manner as the apparatus described above with reference to FIGS 1–4. However, when a web is to be shifted from the storage support structure to the active support structure, the vibrators are activated by the control means to shake the upper elements and thus vibrate the top surfaces of the storage support rods. These vibrations aid in releasing the frictional engagement between the web supported by the support rods and the top surfaces of the support rods, and thus permit sliding motion of the web toward the active support structure.

Figure 7:
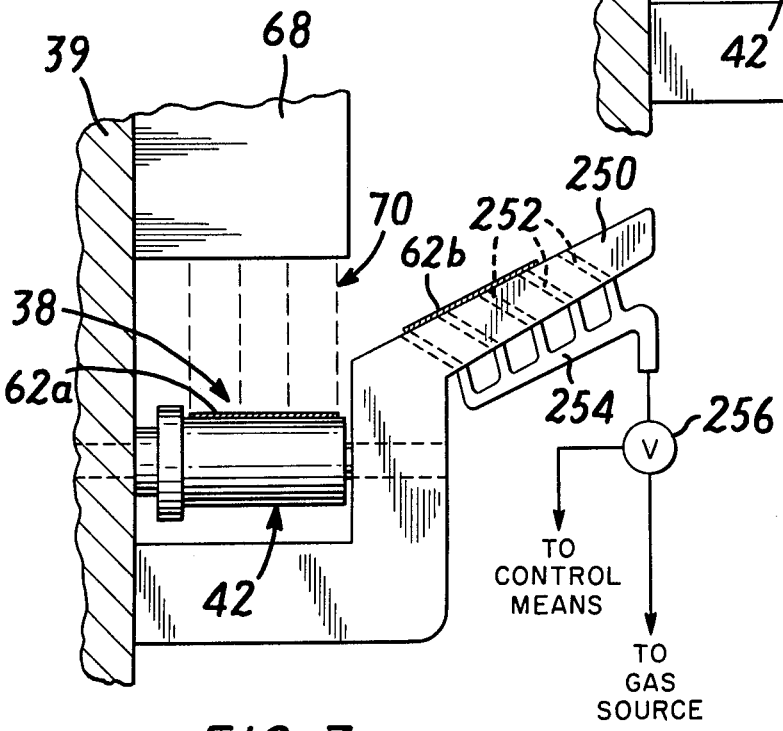

Apparatus according to yet another alternate embodiment of the present invention is partially depicted in FIG. 7. This apparatus is similar to the apparatus described above with reference to FIGS. 1 through 4. However, each of the storage support rods 250 of the apparatus depicted in FIG. 7 has a plurality of holes or passageways 252 extending through it so that each of these holes is open to the top surface of the support rod 250. Each of the holes 252 communicates with a manifold 254 which in turn is connected to a source of gas under pressure via a control valve 256. Each such control valve is connected to the control means of the apparatus so that it may be opened or closed by the control means.

When a web 62*b* disposed on the storage support rods 250 of this apparatus is to be shifted onto the active support structure 38 of the apparatus, the control means signals each valve 256 to open and gas flows from the gas source through each manifold 254 and through the holes 252 in each of the support rods. This gas will be forced between the web to be shifted and the top surfaces of the rods. Thus, the frictional engagement between the web to be shifted and the support rods will be released so that web can readily slide down the support rods and towards the active support path. Because each of the holes 252 in each support rod is directed towards the active support structure 38 (to the left in FIG. 7) the gas flowing from each such hole will flow towards the active support structure and will thereby impel the web 62*b* towards the active support structure.

Although each active support strut 42 of the active support structure 38 in the apparatus described above with reference to FIGS. 1–4 includes a rotatable cylindrical roller 46 (FIG. 3) defining its web support surface, this feature is not essential in all applications. However, the webs processed during use of the apparatus will slide across the top surfaces of the active support struts if the rollers are omitted. Therefore, such surfaces should be extremely smooth and abrasion resistant. Merely by way of example, ceramic wear pads can be mounted atop each active support strut if the rollers are omitted.

As numerous variations and combinations of the features described above can be utilized without departing from the spirit of the present invention as defined in the claims, the foregoing description of the preferred embodiments should be taken by way of illustration rather than by way of limitation of the present invention.

What is claimed is:

1. Web transport apparatus comprising:
(a) a pair of payout stands;
(b) a pair of takeup stands, each such takeup stand being associated with a respective one of said payout stands;
(c) an active support structure defining an active web travel path;
(d) a storage support structure defining a storage path parallel to but laterally displaced from said active path, said support structures being arranged so that a web extending from either one of said payout stands to its associated takeup stand may be supported in said active path by said active support structure and may be fed from such payout stand to such takeup stand, while a web extending from the other one of said payout stands to its associated takeup stand is supported on said storage support structure in said storage path; and
(e) selectively operable web shift means for laterally transferring a web from said storage support structure to said active support structure to shift it from said storage path to said active path.

2. Apparatus as claimed in claim 1 in which said storage support structure includes a plurality of sloping storage support rods disposed in side by side relation along said storage path, the lower end of each such storage support rod being adjacent to said active support structure, so that a web disposed on said storage support rods may slide laterally downwardly onto said active support structure and said web shift means includes retention means for preventing such sliding and means for disabling such retention means to permit such sliding.

3. Apparatus as claimed in claim 2 in which said retention means includes means for tensioning a web disposed on said storage support rods to hold such web against the top surfaces of such rods and said means for disabling includes means for releasing such tension.

4. Apparatus as claimed in claim 3 wherein said means for tensioning includes a pair of brakes, one of such brakes being associated with each of said payout stands, further comprising control means for selectively engaging or releasing each of said brakes, said control means being arranged to release the brake associated with each of said payout stands when the web extending from such stand is to be transferred from said support rods to said active support structure.

5. Apparatus as claimed in claim 4 in which said control means is arranged to engage the brake associated with each of said payout stands while a web extending from such stand is being fed along said active path.

6. Apparatus as claimed in claim 4 in which said control means includes means for activating each of said takeup stands to draw in the web extending thereto while such web is being transferred from said support rods to said active support structure so that such web moves downstream during such transfer.

7. Apparatus as claimed in claim 2 in which said means for retaining includes a of catch finger mounted adjacent to the lower end of one of said storage support rods for movement between a blocking position in which such finger projects upwardly at the lower end of such storage support rod to prevent any sliding motion of a web on such support rod, and a non-blocking position in which it does not so project and said means for disabling includes means for moving said catch finger to its non-blocking position to permit such sliding motion.

8. Apparatus as claimed in claim 2 in which said means for retaining includes the top surfaces of said storage support rods, so that a web disposed on said storage support rods will be retained thereon by frictional engagement with such surfaces, and said means for disabling includes means for vibrating such top surfaces to release such frictional engagement.

9. Apparatus as claimed in claim 2 in which said means for retaining includes the top surfaces of said storage support rods, so that a web disposed on said storage support rods will be retained by frictional engagement with such surfaces, and said means for disabling includes a hole extending through each such support rod to the top surface thereof and means for forcing a gas through such holes to lift any web disposed on said support rods away from such top surfaces and thereby release such frictional engagement.

10. Apparatus as claimed in claim 9 wherein at least one of said holes is directed towards said active support structure so that gas forced through such hole will impel the web disposed on said storage support rods towards said active support structure.

11. Apparatus as claimed in claim 2 in which said web shift means includes a pusher and means for moving said pusher from an initial web engaging position adjacent to the upper end of said storage support rods to an advanced position adjacent to the lower ends of such support rods so that the pusher will force any web disposed on said storage support rods towards said active support structure.

12. Apparatus as claimed in claim 1 in which said active support structure includes a plurality of horizontal struts disposed side by side along said active path.

13. Apparatus as claimed in claim 12 in which the struts adjacent to the middle of the active path are higher than the struts adjacent to the ends of the active path.

14. Apparatus as claimed in claim 12 wherein each of said active support struts includes a cylindrical roller rotatably mounted on the axis of such strut and defining the web support surface of the strut.

15. Apparatus as claimed in claim 1 in which said payout and takeup stands are arranged to respectively dispense and receive webs in lateral alignment with said active path.

16. A method of feeding a sequence of webs through treatment apparatus comprising the steps of:
(a) supporting a first web on an active support structure in an active path extending through the active zone of the treatment apparatus and feeding said web along said path;
(b) disposing a second web along a storage path parallel to but laterally displaced from said active path while the first web is being fed along said active path and supporting said second web with a storage support structure while it is disposed along said storage path; and
(c) shifting said second web from said storage support structure to thereby laterally displace it from said storage path to said active path immediately after the first web has been fed along said active path.

17. A method as claimed in claim 16 wherein said second web is loaded into a payout stand and threaded along said storage path to a takeup stand before such web is shifted to said active path.

18. A method as claimed in claim 16 wherein said second web is shifted from the storage support structure to the active support structure by sliding it laterally on the storage support structure.

19. A method as claimed in claim 18 further comprising the steps of tensioning said second web while it is disposed on the storage support structure to hold such web against the storage support structure and thereby frictionally engage such web with the storage support structure and releasing such tension while such web is shifted to said active support structure.

20. A method as claimed in claim 19 further comprising the steps of frictionally engaging said second web with the storage support structure while such web is disposed on such structure and releasing such frictional engagement by forcing a gas under pressure between said storage support structure and such web while it is shifted to said active support structure.

21. A method as claimed in claim 19 further comprising the steps of frictionally engaging said second web with portions of the storage support structure while such web is disposed on such structure and releasing such frictional engagement by vibrating such portions while such web is shifted to said active support structure.

* * * * *

UNITED STATES PATENT AND TRADEMARK OFFICE

CERTIFICATE OF CORRECTION

PATENT NO. : 4,322,043

DATED : 30 March 1982

INVENTOR(S) : Everett C. Grollimund

It is certified that error appears in the above-identified patent and that said Letters Patent is hereby corrected as shown below:

Claim 1, column 9, line 10, change "structures" to --structure--.

Claim 7, column 9, line 59, delete "of".

Claim 16, column 10, line 47, after the word through, add --a web--.

Claim 16, column 10, line 52, change "said" to --such--.

Claim 16, column 10, line 60, add after the word structure add --to said active support structure--.

Signed and Sealed this

*Eleventh* Day of *December 1984*

[SEAL]

*Attest:*

GERALD J. MOSSINGHOFF

*Attesting Officer*

*Commissioner of Patents and Trademarks*